US006613721B1

(12) United States Patent
Kernizan et al.

(10) Patent No.: US 6,613,721 B1
(45) Date of Patent: Sep. 2, 2003

(54) COLLOIDAL SUSPENSIONS FOR USE AS A LUBRICANT OR ADDITIVE

(75) Inventors: Carl F. Kernizan, Stark County, OH (US); James R. Spence, Summit County, OH (US)

(73) Assignee: The Timken Company, Canton, OH (US)

( * ) Notice: Subject to any disclaimer, the term of this patent is extended or adjusted under 35 U.S.C. 154(b) by 1392 days.

(21) Appl. No.: 08/826,283

(22) Filed: Mar. 27, 1997

(Under 37 CFR 1.47)

Related U.S. Application Data

(63) Continuation of application No. 08/592,871, filed on Jan. 24, 1996, now abandoned, which is a continuation-in-part of application No. 08/175,312, filed on Dec. 29, 1993, now abandoned.

(51) Int. Cl.[7] ..... C10M 109/00; C10M 113/00; C10M 125/00; C10M 133/00

(52) U.S. Cl. ..... 508/103; 508/150; 508/151; 508/390; 508/500; 508/545

(58) Field of Search ..... 508/103, 150, 508/151, 390, 500, 545

(56) References Cited

U.S. PATENT DOCUMENTS

| | | | | |
|---|---|---|---|---|
| 3,635,819 A | | 1/1972 | Kaiser | |
| 3,814,696 A | | 6/1974 | Verdone et al. | |
| 3,917,538 A | * | 11/1975 | Rosensweig | 252/62.51 |
| 3,977,739 A | * | 8/1976 | Moskowitz et al. | 308/187 |
| 4,171,818 A | * | 10/1979 | Moskowitz et al. | 277/80 |
| 4,259,114 A | | 3/1981 | Berke et al. | |
| 4,339,345 A | | 7/1982 | Nakao et al. | |
| 4,356,098 A | * | 10/1982 | Chagnon | 252/62.51 |
| 4,421,660 A | * | 12/1983 | nee Hajna | 252/62.54 |
| 4,604,222 A | * | 8/1986 | Borduz et al. | 252/62.52 |
| 4,615,813 A | | 10/1986 | Bretz | |
| 4,629,753 A | | 12/1986 | Quinn | |
| RE32,573 E | * | 1/1988 | Furumura et al. | 252/62.52 |
| 4,729,791 A | | 3/1988 | Laura et al. | |
| 5,028,489 A | | 7/1991 | Kissel | |
| 5,064,550 A | * | 11/1991 | Wyman | 252/62.52 |
| 5,085,789 A | * | 2/1992 | Yokouchi et al. | 252/62.52 |
| 5,104,742 A | | 4/1992 | Hayner et al. | |
| 5,188,799 A | | 2/1993 | Mori et al. | |

OTHER PUBLICATIONS

Saida, et al, The Effect of Reaction Condition on Composition and Properties of Ultrafine Amorphous Powders in (Fe, Co,Ni)–B Systems Prepared by Chemical Reduction, *Metallurgical Transactions A*, vol. 22A, Sep. 1991, p. 2125–2132.

Whitaker, Ann; Ferrolubricants, George C. Marshall Space Flight Center, p. 165–169(Date Unknown).

Kim et al; Growth of Ferromagnetic Particles from Cation Reaction by Borohydride Ions, *Journal of Colloid and Interface Science*, vol. 116. No. 2, Apr. 1987, p. 431–443.

* cited by examiner

*Primary Examiner*—Margaret Medley
(74) *Attorney, Agent, or Firm*—Polster, Lieder, Woodruff & Lucchesi, L.C.

(57) ABSTRACT

A colloidal suspension has a metal core surrounded by a surfactant. The colloidal suspension is about 0.5 micron to about 3–4 microns in diameter. The colloidal suspension acts as a lubricant and protects surfaces in rolling and/or sliding contact. When mixed with a lubricant, the colloidal suspension increases the operating life of the lubricated item. The colloidal suspension preferably is tin or bismuth nano-phase particles encased in a surfactant, preferably oleyl sarcosinate, N-coco sarcosinate, sodium sulfonate, petroleum sulfonate, or octadecenyl amine.

10 Claims, 2 Drawing Sheets

REACTION SET-UP FOR COLLOIDAL SUSPENSIONS

COLLOIDAL SUSPENSIONS FOR USE AS A LUBRICANT OR ADDITIVE

RELATED APPLICATIONS

This is a continuation application of application Ser. No. 08/592,871, filed on Jan. 24, 1996 now abandoned which is a continuation in part of application Ser. No. 08/175,312 filed on Dec. 29, 1993 now abandoned.

BACKGROUND OF THE INVENTION

This invention relates to lubricants, and, in particular to the synthesis of colloidal suspensions for use as lubricants or lubricant additives.

Lubricants, such as oil and grease, are required in products such as bearings, wherein two contacting surfaces roll and/or slide against each other. Under certain operating conditions relating to loads and high speeds, the two surfaces can interact by metal-to-metal contact. This condition requires additives to the lubricants, known as EP additives, which help protect the functional surfaces. Previously, additives were used which chemically reacted with the surface. The present invention does not chemically react with the surface, but instead bonds to the surface and provides a protective layer or coating to the surface. It contains elemental metal particles which are softer than the bearing surfaces and have the ability to coat the surfaces and fill in surface asperities in the surfaces.

SUMMARY OF THE INVENTION

A principle object of this invention is to provide a novel lubricant composition which has the ability to fill in surface asperities and reduce friction by forming a lubricating layer on the contacting surfaces of two components in relative motion to each other (i.e., the rolling elements and raceways for a bearing) thereby extending the life of the components.

Another object is to provide a colloidal suspension for use as a lubricant additive which will protect bearing contact or operating surfaces.

Still another object is to provide methods for making such colloidal suspensions and lubricant compositions.

These and other objects will become apparent to those skilled in the art in light of the following disclosure and accompanying drawings.

The invention, briefly stated, comprises a colloidal suspension which behaves as a lubricant or may be added to a lubricant. The colloidal suspension includes a non-magnetic elemental metal core, preferably of tin, surrounded by a surfactant. The metal colloid is about 0.5 microns to about 3 or 4 microns in diameter. The surfactant preferably comprises an octadecenyl amine, a sarcosinate, or a sulfonate, but many other surfactants well known in the art are suitable.

The colloidal suspension is produced by reducing a metal salt to produce nano-phase metal particles and mixing the reduced nano-phase metal particles with a surfactant. The metal is provided as a metal salt which is dispersed in either an aqueous solution, a hydrocarbon (preferably methanol) solution, or a two phase water/hydrocarbon system to make a metal salt solution. The metal salt solution is mixed with a borohydride solution under an oxygen free atmosphere to reduce the metal. The flask in which the reduction occurs is purged with a noble gas, preferably argon. The borohydride solution includes borohydride, hydroxide, solvent, and water. The surfactant preferably also is added to the borohydride solution. The mixture is heated and stirred. The reduction of the metal salt in the borohydride solution with surfactant produces nano-phase elemental metal particles which are coated with the surfactant to produce the colloidal suspension. The colloidal suspension is collected by separating the reaction products from the liquid. This includes distilling the water from the solution, preferably by azeotropic distillation. This leaves a slurry of the solvent and the colloidal suspension which is filtered to separate the colloids from the solution.

BRIEF DESCRIPTION OF THE DRAWINGS

In the drawings, wherein like numbers refer to like parts whenever they occur.

DESCRIPTION OF THE PREFERRED EMBODIMENT

Figure 1:
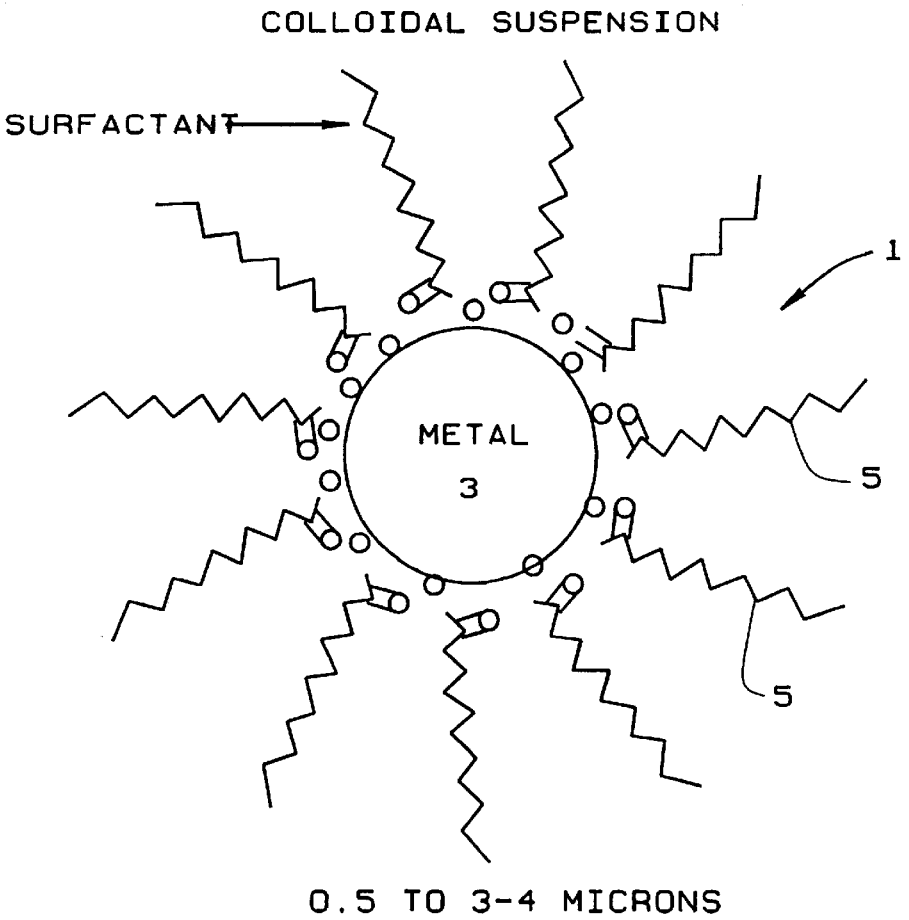
FIG. 1 is a diagramatic representation of a colloidal suspension of the present invention.

FIG. 1 shows a diagramatic drawing of a colloidal suspension 1 of the present invention. The colloidal suspension 1 has an elemental non-magnetic metal core 3 with a layer of surfactant 5 adhered thereto. As is discussed in detail below, the colloidal suspension 1 is produced by reducing metal salts with a borohydride in a two phase hydrocarbon/water system to produce a nano-phase metal particle 3 and mixing the resulting nano-phase particles 3 with surfactants 5. The surfactants 5 adhere or bind to the nano-phase particles 3 to produce the colloidal suspension 1. The colloidal suspension 1 behaves as a lubricant and allows operation of a bearing for extended periods of time under severe lubrication conditions. It also coats operating surfaces of the bearing to extend the operating life of a lubricated bearing.

The reduction of the metal salt produces nano-phase non-magnetic elemental metal particles 3 having diameters ranging from about one nanometer to about one micron. The metal particles 3 are mixed with a surfactant 5, which preferably is present in the reaction flask in which the reduction takes place. The surfactant 5 binds to the metallic particles 3 to produce the colloidal suspension 1 shown in FIG. 1, which has a diameter ranging from about 0.5 microns to about 3–4 microns.

When the colloidal suspension 1 is added to a lubricant, the surfactants suspend the nano-phase metal particles 3 in the lubricant. Tests, which are discussed below, indicate that the colloidal suspension 1 acts as a lubricant, repairs damaged surfaces of bearings and allows bearings to run for extended periods of time without oil.

The metal particles are non-magnetic because it is desired to use the lubricant in steel bearing compositions and magnetic metal colloids are too hard to fill in surface asperities which is a desired attribute of the composition of this invention. The compositions contain elemental metal particles because metallic salts, such as oxides and sulfites also are too hard to fill in surface asperities. In fact, these materials instead of filling surface asperities have an abrasive quality and tend to wear away contacting surfaces.

Figure 2:
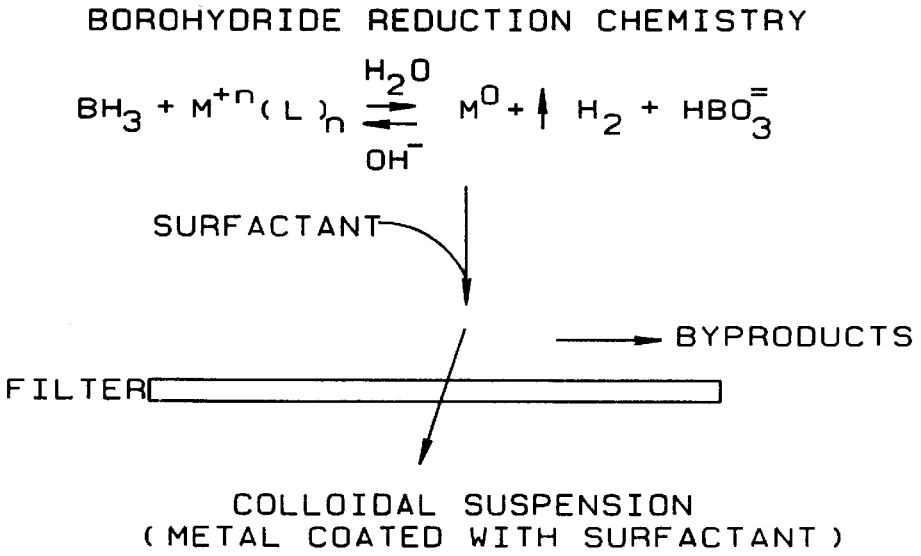
FIG. 2 is a diagramatic representation of a method of producing the colloidal suspension.
Figure 3:
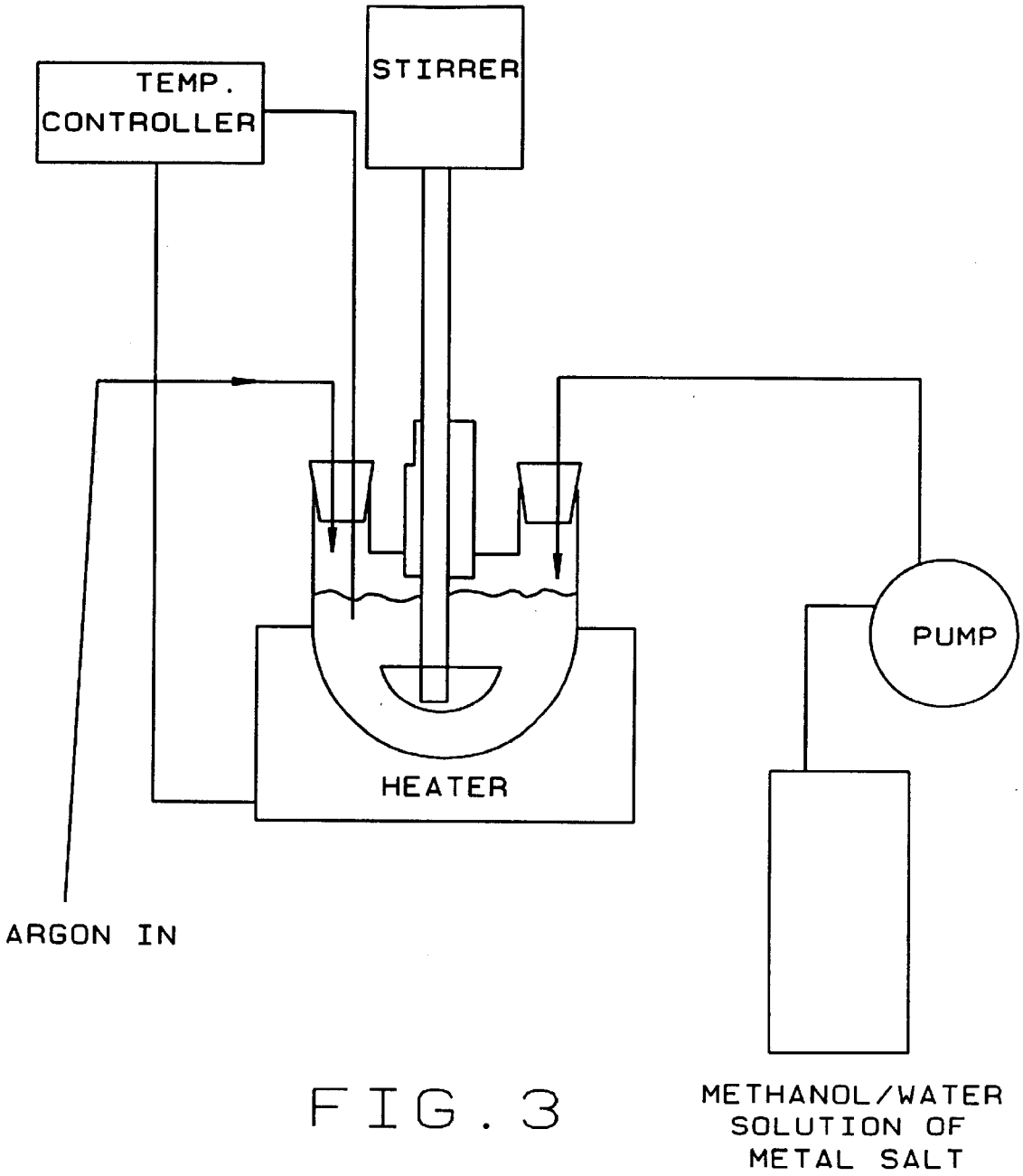
FIG. 3 is a diagramatic representation of the equipment used to produce the colloidal suspensions of the present invention.

The production of the oil soluble, colloidal suspension is performed by reducing transition metal salts with a borohydride in an alkaline reaction. The equipment used to produce the colloidal suspension is shown in FIG. 3. The reaction is shown in FIG. 2. To produce the colloidal suspensions, salts of non-magnetic metals are dispersed in water, alcohol or a water/alcohol solution. If the water/alcohol solution is used, the solution preferably is 50% water and 50% alcohol. Methanol preferably is used as the alcohol. The metal solution preferably contains about 0.040 to about 0.505 equivalents of a metal ion (tin was used in the experimental work) in 50–100 ml of liquid.

The metal solution is mixed with a solution of a borohydride, potassium hydroxide, a solvent, and water. The potassium hydroxide is added to the system to ensure the reduction occurs in a basic solution. Other bases can be used. The borohydride solution includes 1–14 grams borohydride, 1–10 grams potassium hydroxide, 100–500 ml solvent, and 25–100 ml water. The borohydride preferably is potassium or sodium borohydride, although other borohydrides can be used. The solvent preferably is toluene, although other suitable solvents can be used. A surfactant also is added to the borohydride solution, and preferably is added to the borohydride solution before the metal solution and the borohydride solution are mixed. Preferably 10 to 50 grams of surfactant is added to the system. The surfactant preferably is an octadecenyl amine, oleyl sarcosinate, N-coco sarcosinate, sodium sulfonate, or a petroleum sulfonate. These surfactants are indicated as preferable, but other surfactants are suitable and can be used in the invention. It is not intended to limit the invention to the specific surfactant families named.

The metal solution and borohydride solution are mixed together over a period of time. Preferably, the two solutions are mixed together at a rate of from about 0.5 cc/min to about 3 cc/min. When tin salts are used, the formation of the colloidal suspension is found to occur more readily if the borohydride solution is added to the metal salt solution. The mixed solution is heated to between 30° C. to 50° C. and stirred. The reaction is performed in an oxygen free atmosphere. As seen in FIG. 3, argon gas is introduced into the flask in which the reaction occurs to displace any oxygen that is present in the flask. As shown in FIG. 2, the metal salt disassociates to form a nano-phase metal particle which is coated with the surfactant. The colloidal suspension formed has a diameter on the order of about 0.5 microns to 3–4 microns or more. The precipitation or formation of the nano-phase metal particles occurs very rapidly upon the mixing of the metal and borohydride solutions. Because the surfactant is present in the reaction chamber or flask, the nano-phase metal particles formed are coated with the surfactant essentially as they are formed. After the metal salt and borohydride solutions have been mixed, the colloidal suspensions are filtered and collected.

To collect the colloidal suspensions, the water phase is initially distilled off, preferably by azeotropic distillation, leaving a slurry consisting of the hydrocarbon phase and the colloidal suspensions. The slurry is then filtered to separate the colloidal suspensions from the hydrocarbon phase. A filter having pores larger than the hydrocarbon molecules, but smaller than the colloidal suspensions, is used. The hydrocarbon phase thus passes through the filter, leaving the colloidal suspensions on the filter. Other methods could, of course, be used to separate the colloidal metals from the hydrocarbon and/or water phases.

The metals preferably are bismuth and tin, although other non-magnetic metals, including, but not limited to, zinc, copper, and silver can be used. However, the metals must be in elemental form. Their compounds, such as oxides and sulfides, are too hard and tend to score bearing surfaces rather than being soft enough to fill in the asperities. Magnetic elements and their compounds have the same deficiencies. The invention is applicable to sliding surfaces in addition to rolling elements. In the colloidal suspensions, the metal makes up from about 6% to about 30% by weight and the surfactant makes up about 70% to about 94% by weight. The colloidal suspension is about 0.5 micron to about 3–4 microns in diameter, and preferably about 1 micron to about 2 microns in diameter.

In adding the colloidal suspension to a lubricant, such as oil, polyalphaolefins, or grease, about 1 to about 5 grams of the colloidal suspension are added to about 10 grams to about 20 grams of lubricant.

The essence of the present invention is a lubricating colloidal suspension comprising only soft, non-magnetic elemental particles that have the ability to coat the contacting surfaces forming a lubricating layer that reduces friction and fills in surface asperities in the contacting surfaces thereby extending the life of the components.

EXAMPLE 1

10 grams stannous (II) chloride.$H_2O$ is dispersed in 100 cc methanol and pumped into a slurry of 1.8 grams potassium borohydride, 50 cc water, 1.4 grams potassium hydroxide, 10 grams sodium sulfonate and 100–150 cc toluene. The stannous chloride is pumped in at a rate of 1 cc/min. An ingot of tin was found in the flask, but no tin was found in the sulfonate by either TGA or SRD analysis.

EXAMPLE 2

1.2 grams sodium borohydride, 1 grams potassium hydroxide, 100 cc methanol, 25 grams of an octadecenyl amine (i.e. Duomeen-O) and 200 cc toluene are mixed in a 500 ml flask. 10 grams stannous chloride slurried in 100 ml 50/50 water/methanol is added to the flask over an hour. After the addition of the metal salt to the borohydride solution, the colloidal suspension is collected. Filtration of the product is difficult but produces a grey paste with 13% colloidal tin solids.

EXAMPLE 3

Example 2 is repeated, but with reverse addition. The borohydride solution is added to the stannous chloride solution, rather than the other way around. The product is estimated to be 6.4% tin by weight from TGA analysis. Tests show some anti-oxidant capacity. The test results could not be reproduced and other tests show that the tin product had no measurable effect on the oxidation stability of oils or greases.

EXAMPLE 4

2.4 grams potassium borohydride, 10 grams potassium hydroxide, 30 grams N-coco sarcosinate (from Grace Chemical), and 50 cc water are placed in a 500 ml flask. The solution is filled to 250 ml with toluene. 20 grams stannous chloride dispersed in 50 cc water at 30° is pumped into the mixture. After addition is completed, several drops (7–10 ml) of Dow Antifoam-A are added. Excess borohydride is added until hydrogen evolution ceases. The water is then removed by azeotropic distillation and the remaining product is filtered from the toluene slurry. The product is found to be 31.6% solid by TGA analysis. Differential Scanning Calorimetry (DSC) analysis shows the product (a gray semi-solid) contains 25% tin. XRD analysis shows only tetragonal tin, also called synthetic tin.

The 25% tin product was placed into a damaged ball bearing having micropits in its race. The colloidal tin coated the race and allowed the bearing to run for 56 hours, without other lubricants, before failing.

In a second test, a tapered bearing was lubricated with 50 mg of 80% 8 cst PAO (polyalphaolefin) and 20% colloidal tin. At 2000 RPM and 730 lbs. load, the bearing ran 1.23 million revolutions before failing due to thermal runaway. With only the base oil and the surfactant N-coco sarcosinate (i.e., no nano-phase tin particles) the bearing ran 640,000 revolutions. When only 50 mg of an HP grease was used as a lubricant, the bearing ran only 320,000 revolutions.

In a second set of tests, a new tapered bearing was lubricated with 4 cc of a lubricant mixed with the 25 wt % tin colloidal suspension. The bearing was run for 4,000,000 revolutions at 900 lbs. load. The lubricant was opaque before the test and a clear green after the test. Light microscopy revealed surface filling of tooling marks on the bearing rollers and on the center portion of the bearing raceways. Scanning Electron Microscopy (SEM) indicates that most of the tin resided on the surface of the bearing.

As can be appreciated, the nano-phase colloidal tin particles, when added to a lubricant, greatly reduce the friction in a system, allowing the system to operate for much greater periods of time. The nano-phase tin also coats the surfaces to which it is applied, filling in slight surface asperities (i.e., the tooling marks) to enhance the operation of the coated item.

The above tests show that hydrocarbon and oil soluble colloidal suspensions have unique oil thickening properties which may be advantageously used to increase the operating life of lubricated items, such as bearings. Variations within the scope of the appended claims may be apparent to those skilled in the art. The foregoing description is thus intended to be illustrative only and is not meant to be limiting.

What is claimed is:

1. A composition for lubricating contacting surfaces on components in relative motion to each other comprising:

a) a lubricant, and b) a colloidal suspension having elemental nano-phase metallic core particles selected from the group consisting of bismuth, tin, zinc, copper, and silver and a surfactant adhering to and surrounding the metal core, the lubricant composition being characterized in that it coats the said contacting surfaces to which it is applied and fills in surface asperities in those surfaces to extend the life of the contact surfaces.

2. The composition of claim 1 wherein the lubricant is selected from the group consisting essentially of oils, greases, and polyalphaolefins.

3. The composition of claim 1 wherein the surfactant is chosen from the group consisting of sarcosinates, sulfonates, and octadecenyl amine.

4. The composition of claim 3 wherein the sarcosinates comprise oleyl sarcosinate or N-coco sarcosinate.

5. The composition of claim 3 wherein the sulfonates comprise sodium sulfonate or petroleum sulfonate.

6. The composition of claim 1 having about 1–5 grams of the colloidal suspension per about 10–20 grams of the lubricant.

7. The composition of claim 1 wherein the colloidal suspension is oil soluble.

8. The composition of claim 1 wherein the contact surfaces are on the rolling elements and raceways of a bearing.

9. The composition of claim 1 wherein the colloidal suspension having a metal content by weight of about 6–30% and a surfactant by weight of about 70–94%.

10. A rolling element bearing lubricant composition comprising a) a lubricant selected from the group consisting of oils, greases and polyalphaolefins, b) elemental nano-phase metallic particles selected from the group consisting essentially of bismuth, tin, zinc, copper, and silver, c) a surfactant, and d) wherein the rolling element bearing has contacting surfaces between its rolling elements and raceways, and the lubricant composition is characterized in that during rotation of the bearing the elemental metallic particles bond to the contacting surfaces of the bearing to which it is applied thereby forming a lubricant layer and filling in surface asperities in the contacting surfaces.

* * * * *